US007703280B2

(12) United States Patent
Kobayashi et al.

(10) Patent No.: US 7,703,280 B2
(45) Date of Patent: Apr. 27, 2010

(54) HYDRAULIC RIDE CONTROL SYSTEM FOR WORKING VEHICLE

(75) Inventors: Yoshinobu Kobayashi, Tsuchiura (JP); Hiroshi Matsuzaki, Tsuchiura (JP); Katsumi Ueno, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 83 days.

(21) Appl. No.: 11/272,741

(22) Filed: Nov. 15, 2005

(65) Prior Publication Data

US 2006/0101815 A1 May 18, 2006

(30) Foreign Application Priority Data

Nov. 16, 2004 (JP) ..... 2004-331888

(51) Int. Cl.
*F16D 31/02* (2006.01)

(52) U.S. Cl. ..... 60/469

(58) Field of Classification Search ..... 60/413, 60/469

See application file for complete search history.

(56) References Cited

U.S. PATENT DOCUMENTS 5,520,499 A * 5/1996 Ufheil et al. ..... 60/413
5,733,095 A * 3/1998 Palmer et al. ..... 60/413
5,992,146 A * 11/1999 Hausman ..... 60/469
6,321,534 B1 * 11/2001 A'Hearn et al. ..... 60/469
2005/0072144 A1 * 4/2005 Bitter et al. ..... 60/413
2007/0056277 A1 * 3/2007 Mizoguchi et al. ..... 60/413

FOREIGN PATENT DOCUMENTS

JP 06330535 A * 11/1994
JP 2000-309953 A 11/2000

* cited by examiner

*Primary Examiner*—F. Daniel Lopez
(74) *Attorney, Agent, or Firm*—Crowell & Moring LLP

(57) ABSTRACT

A hydraulic ride control system for a working vehicle such as a wheel loader is provided with boom cylinders, an actuator control valve for controlling a pressure in bottom pressure chambers of the boom cylinders, an accumulator connected to the bottom pressure chambers of the boom cylinders via a connection line, an opening control valve having a pilot chamber to selectively communicating or cutting off the connection line depending on a pressure in the pilot chamber, and a selector unit for selectively feeding a pressure to or draining a pressure from the pilot chamber. The selector unit comprises a controller for variably controlling an opening of the opening control valve.

6 Claims, 7 Drawing Sheets

HYDRAULIC RIDE CONTROL SYSTEM FOR WORKING VEHICLE

FIELD OF THE INVENTION

This invention relates to a hydraulic ride control system for a working vehicle such as a wheel loader.

DESCRIPTION OF THE BACKGROUND

In digging/loading work by a wheel loader, earth, sand or the like loaded in a bucket is often moved to a predetermined place. When traveling with the load, up and down movements of the vehicle cause a boom to swing up and down due to an increased weight of the bucket, and as a result, amplify vibrations of the vehicle.

With a view to suppressing these vibrations, a bottom pressure chamber of a boom cylinder and an accumulator are brought into communication with each other during traveling to have pressure fluctuations in the bottom pressure chamber absorbed in the accumulator, and during digging work with a bucket, on the other hand, the communication with the accumulator is cut off to prevent the absorption of digging force in the accumulator. As a conventional technique of this sort, reference can be made to JP-A-2000-309953.

FIG. 9 illustrates an essential part of the technique disclosed in JP-A-2000-309953 although it is not any of the drawings contained in this patent publication. Taking FIG. 9 as the conventional technique, a description will hereinafter be made. The conventional technique shown in FIG. 9 is provided with hydraulic cylinders arranged on a working vehicle, specifically boom cylinders 51, an actuator control valve for controlling a pressure in pressure chambers of these boom cylinders 51, specifically an actuator control valve 54, and main lines 52, 53 connecting the actuator control valve 54 and bottom pressure chambers 51*a* and rod pressure chambers 51*b* of the boom cylinders, respectively, and is also equipped with a branch circuit 50 branched out from the main lines 52,53. The branch circuit 50 has branch lines 55,56 branched out from the main lines 52,53, respectively, and these branch lines 55,56 are connected to an accumulator 58 and reservoir 61, respectively, via an opening control valve 57. Responsive to a signal from a controller 60, a solenoid valve 59 is switched so that the opening control valve 57 switched into a closed position G or open position H.

During digging work with the bucket, the opening control valve 57 is in the closed position G, so that the bottom pressure chambers 51*a* of the boom cylinder 51 and the accumulator 58 are kept out of communication to prevent the absorption of digging force, which is applied to the boom cylinders 51, in the accumulator 58.

During traveling, on the other hand, the solenoid valve 59 is switched to bring the opening control valve 57 into the closed position H. The bottom pressure chambers 51*a* of the boom cylinders 51 are, therefore, brought into communication with the accumulator 58 to have fluctuations in the load on the bottom pressure chambers 51*a* absorbed in the accumulator 58, so that vibrations of the vehicle can be suppressed.

In the above-described conventional technique, the opening control valve 57 is arranged to selectively bring the bottom pressures 51*a* of the boom cylinder 51 into communication with the accumulator 58 or to selectively cut off their communication. During the communication, the opening of the opening control valve 57 always remains constant. The weight of a front part, however, varies depending on the material or the like loaded on the bucket, the vehicle class, the front attachment, and the like. When the opening of the opening control valve 57 is excessively small relative to the weight of the front section, fluctuations in the load applied on a boom may not be fully absorbed in the accumulator 58 in some instances, in other words, vibrations may not be suppressed in some instances. When the opening is conversely too large relative to the weight of the front section, the vibrations of the front section may not be sufficiently attenuated so that the body of the working vehicle may be shaken to make it unstable in some instances. Accordingly, the conventional technique may not be able to fully absorb, in some instances, vibrations which take place as a result of a change in the weight of the front section.

SUMMARY OF THE INVENTION

An object of the present invention is to provide a hydraulic ride control system for a working vehicle, which irrespective of a variation in the weight of a front section of the vehicle, can suppress vibrations that take place when travelling with a load.

To achieve the above-described object, the present invention provides a hydraulic ride control system for a working vehicle, said system being provided with a hydraulic cylinder, an actuator control valve for controlling a pressure in a pressure chamber of the hydraulic cylinder, an accumulator connected to the pressure chamber of the hydraulic cylinder via a connection line, an opening control valve having a pilot chamber for selectively communicating or cutting off the connection line depending on a pressure in the pilot chamber, and a selector means for selectively feeding a pressure to or draining a pressure from the pilot chamber, wherein the selector means comprises a control means for variably controlling an opening of the opening control valve.

According to the present invention constructed as described above, it is only necessary to perform control by the control means such that the opening of the opening control valve becomes smaller when the weight of the front section is relatively small but becomes larger when the weight of the front section is large. In other words, the opening control valve can be controlled to an optimal opening by the control means in accordance with a change in the weight of the front section, and therefore, vibrations which take place when traveling with a load can be suppressed irrespective of a change in the weight of the front section.

In the above-described invention, the selector means may comprise a solenoid-operated proportional valve for controlling the opening control valve.

In the above-described invention, the hydraulic ride control system may further comprise a load pressure detection means for detecting a load pressure on the hydraulic cylinder and outputting a signal corresponding to the load pressure; and responsive to a signal outputted from the load pressure detection means, the control means may change the opening of the opening control valve.

In the above-described invention, the hydraulic ride control system may further comprise a vehicle speed detection means for detecting a vehicle speed of the working vehicle and outputting a signal corresponding to the vehicle speed; and responsive to a signal outputted from the vehicle speed detection means, the control means may change the opening of the opening control valve.

In the above-described invention, the hydraulic ride control system may further comprise an opening instruction means for outputting, responsive to an input by an operator, a signal that instructs an opening of the opening control valve; and responsive to the signal outputted from the opening instruction means, the control means may change the opening of the opening control valve.

In the above-described invention, the hydraulic ride control system may further comprise a selector valve arranged on a bypass line branching out from the connection line and disposed in parallel with the opening control valve such that the bypass line may normally be maintained in communication but may be cut off when a load pressure on the hydraulic cylinder has increased to at least a predetermined pressure.

In the above-described invention, a check valve may be arranged on the bypass line to bleed a pressure only from the hydraulic cylinder to the accumulator.

As the present invention can variably control the opening of the opening control valve by the control means depending on the weight of the front section, vibrations which take place when travelling with a load can be suppressed irrespective of the change in the weight of the front section. The present invention, therefore, makes it possible to improve the vibration suppression performance over the conventional technique.

DETAILED DESCRIPTION OF THE INVENTION AND PREFERRED EMBODIMENTS

Based on the accompanying drawings, a description will hereinafter be made of best modes for practicing the hydraulic ride control system according to the present invention for the working vehicle.

Figure 1:
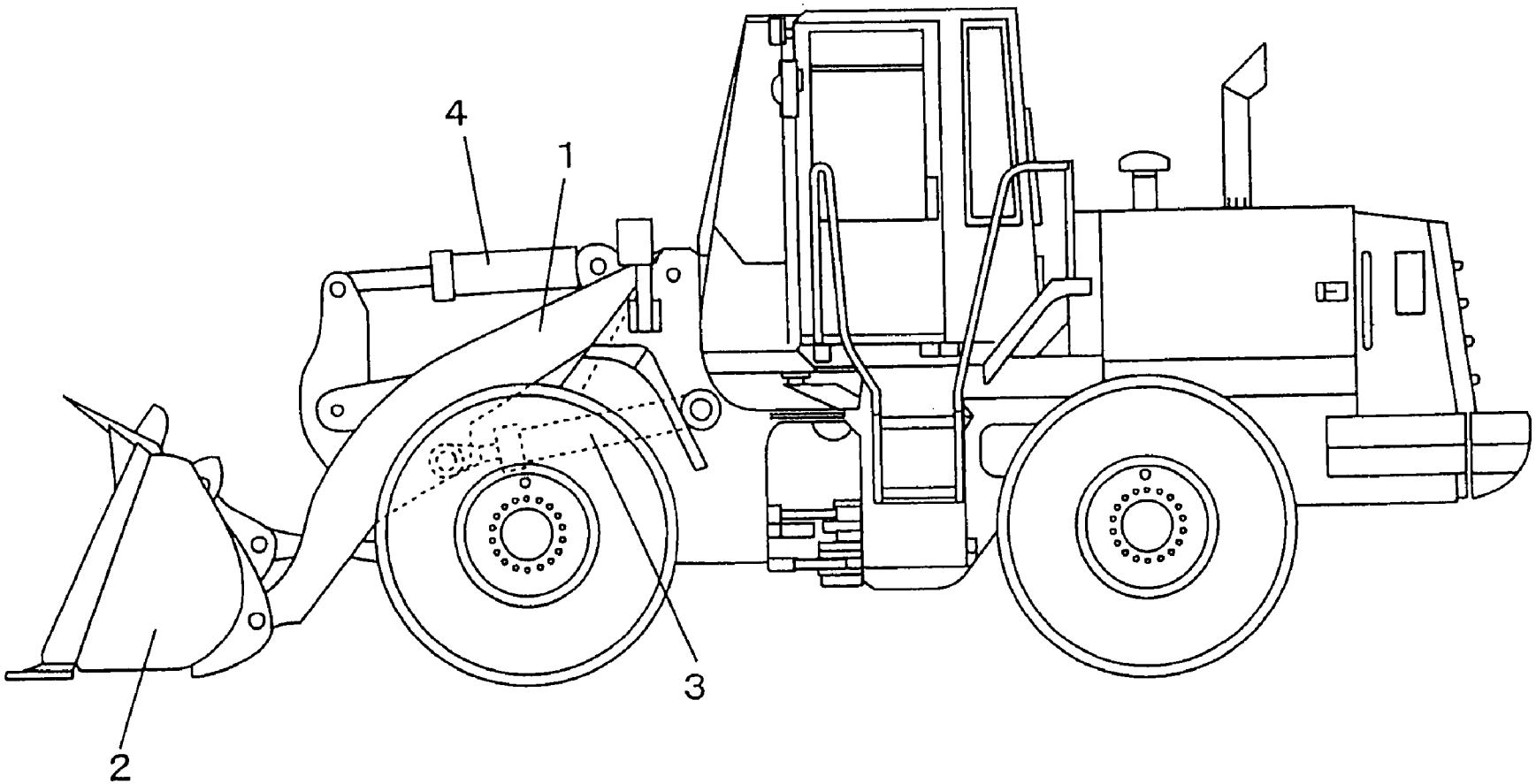
FIG. 1 PRIOR ART
FIG. 1 is an external view of a wheel loader referred to as one example of working vehicles to which a hydraulic ride control system according to a first embodiment of the present invention can be applied.

Referring first to FIG. 1, the wheel loader has a boom 1 mounted on a vehicle body and a bucket 2 attached to a free end of the boom 1, and these boom 1 and bucket 2 can be actuated by a pair of boom cylinders 3 and a pair of bucket cylinders 4, respectively.

First Embodiment

Figure 2:
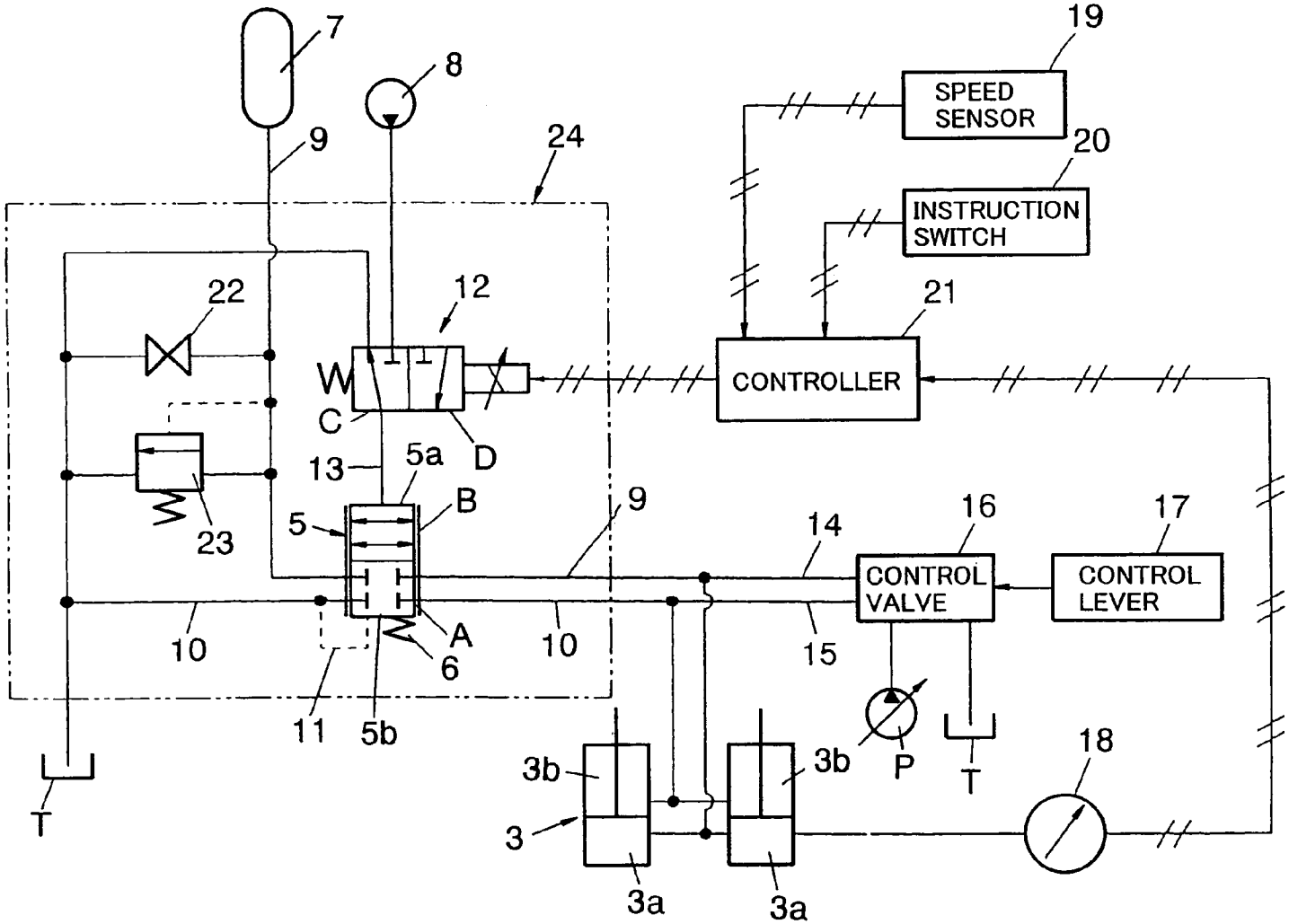
FIG. 2 is a circuit diagram illustrating the hydraulic ride control system according to the first embodiment of the present invention.

Referring next to FIG. 2, the hydraulic ride control system according to the second embodiment has a branch circuit 24 branched out from a main circuit for driving the boom cylinder 3. Bottom pressure chambers 3*a* and rod pressure chambers 3*b* of the boom cylinders 3 are connected to an actuator control valve 16 via main lines 14 and 15, respectively. The actuator control valve 16 bleeds a pressure from a hydraulic pump P to ones of the bottom pressure chambers 3*a* and rod pressure chambers 3*b* of the boom cylinders 3 in accordance with a control stroke of a control lever 17, or brings the other pressure chambers into communication with a reservoir T. As a result, the boom cylinders 3 extend or retract.

The branch circuit 24 is equipped with branch lines 9 and 10, which are branching out from the main lines 14 and 15, respectively, and are connectable to an accumulator 7 and the reservoir T, respectively, via an opening control valve 5. It is to be noted that the branch line 9 can connect the bottom pressure chambers 3*a* of the boom cylinder 3 to the accumulator 7 while the branch line 10 can connect the rod pressure chamber 3*b* of the boom cylinders 3 to the reservoir T.

The opening control valve 5 is a 4-port-2-position selector valve, and is driven when a pressure is bled from a pressure supply 8 to a pressure chamber 5*a* via a solenoid-operated proportional valve 12 and a pilot line 13. The other pressure chamber 5*b* of the opening control valve 5 is connected to the reservoir T via a drain line 11 and the branch line 10. Further, the pressure chamber 5*b* is provided with a return spring 6.

Normally, the opening control valve 5 is urged by the return spring 6 and remains in a closed position A, so that the branch lines 9,10 are cut off. When a pressure is bled to the pressure chamber 5*a*, the opening control valve 5 is brought into an open position B so that the branch lines 9, 10 are connected to the accumulator 7 and reservoir T, respectively.

The solenoid-operated proportional valve 12 is opened or closed responsive to an electrical signal from a control means for variably controlling the opening of the opening control valve 5, for example, a controller 21. While the solenoid-operated proportional valve 12 is held neutral, it remains in a position C so that the pressure chamber 5*a* is connected to the reservoir T via the pilot line 13. Upon receipt of a signal from the controller 21, however, the solenoid-operated proportional valve 12 is brought into a position D responsive to the signal so that a pressure is bled from the pressure supply 8 to the pressure chamber 5*a* via the pilot line 13. Electrically connected to the controller 21 are a load pressure detection means connected to the bottom pressure chambers 3*a* of the boom cylinders 3 for detecting a load pressure in the bottom pressure chambers 3*a* and outputting a signal corresponding to the load pressure, for example, a pressure sensor 18; a vehicle speed detection means for detecting a travelling speed of the wheel loader and outputting a signal corresponding to the travelling speed, for example, a speed sensor 19; and an opening instruction means for outputting, in response to an input by an operator, a signal instructing an opening of the opening control valve 5, for example, an instruction switch 20. To the solenoid-operated proportional valve 12, the controller 21 outputs control signals corresponding to the respective signals.

It is to be noted that the above-mentioned controller 21, solenoid-operated proportional valve 12 and pressure supply 8 make up a selector means for selectively feeding or draining a pilot pressure to or from the pilot chamber 5*a* of the opening control valve 5.

The branch circuit 24 is also provided with a cock 22 and a relief valve 23, which are arranged in parallel with each other between the accumulator 7 and the reservoir T.

Figure 3:
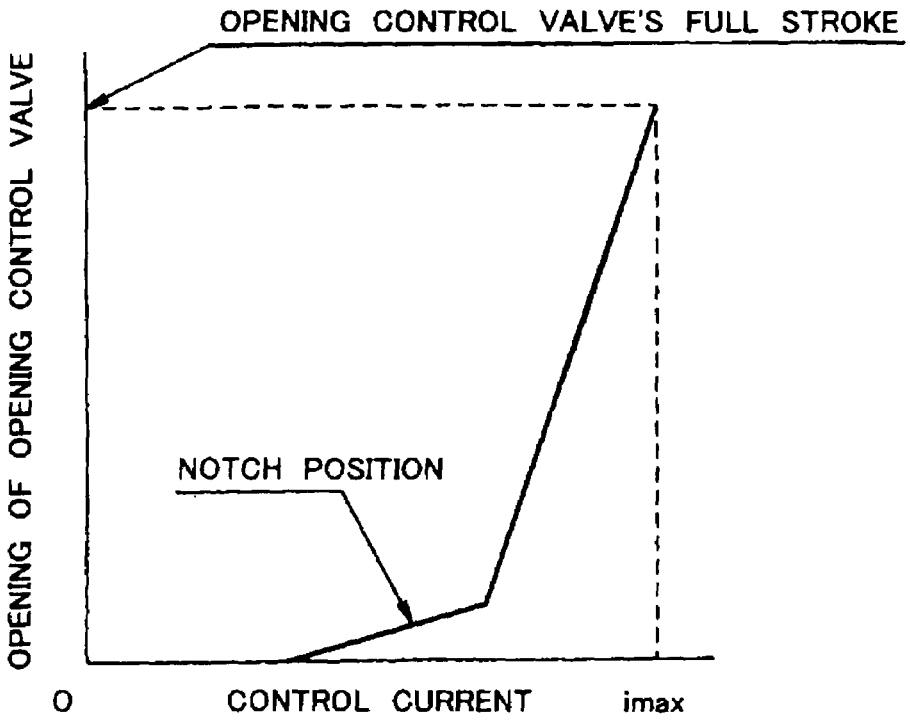
FIG. 3 is a diagram showing one example of opening characteristics of an opening control valve as available from the hydraulic ride control system according to the first embodiment of the present invention.

With reference to FIG. 3, illustrative opening characteristics of the opening control valve 5 depicted in FIG. 2 will be descried. The abscissa represents control currents which the solenoid-operated proportional valve 12 receives from the controller 21, while the ordinate represents openings of the opening control valve 5. When a control current is transmitted to the solenoid-operated proportional valve 12, a pressure corresponding to the current value is bled to the pressure chamber 5*a* so that the opening control valve 5 is caused to move through a stroke. The maximum value of the opening of the opening control valve 5 is set corresponding to an expectable maximum value of the load pressure on the boom cylinders 3. A current value at which the opening is brought to the maximum, that is, the on/off value 5 is caused to move through full stroke is indicated by $i_{max}$. In the example of FIG. 3, a notch is formed on the opening control valve 5 to provide a range in which the opening can be finely controlled.

Figure 4:
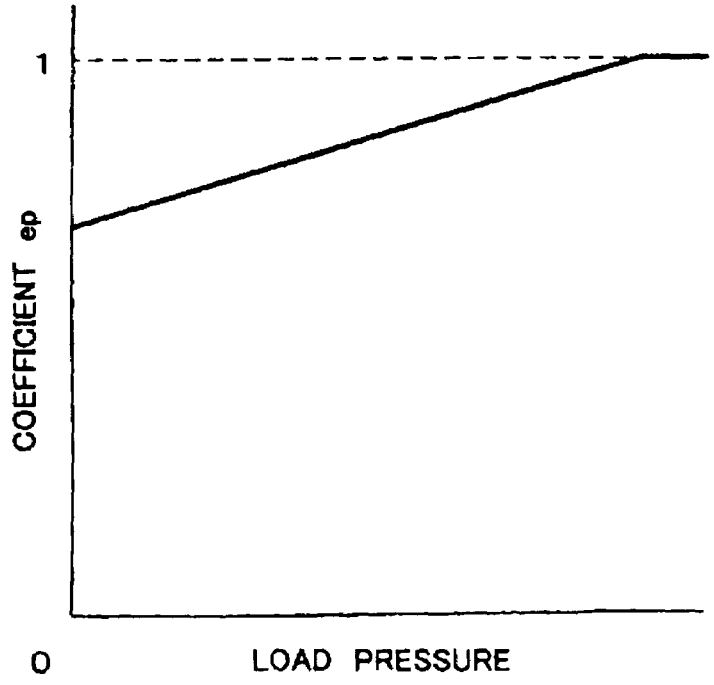
FIG. 4 is a diagram depicting one example of a relationship between a load pressure and a coefficient function set by a controller in the hydraulic ride control system according to the first embodiment of the present invention.

Referring to FIG. 4, a description will be made of an illustrative relationship between a load pressure on the bottom pressure chambers 3*a* of the boom cylinders 3 and a coefficient function set by the controller 21 as shown in FIG. 2. The abscissa represents load pressures on the bottom pressure chambers 3*a* of the boom cylinders 3, while the ordinate represents output-computing coefficients ep in the controller 21. In this example, a coefficient ep that ranges from 0 to 1 and determines the magnitude of a control current to be outputted to the solenoid-operated proportional valve 12 is computed based on a pressure detected at the pressure sensor 18. The greater the load pressure, the greater the coefficient ep, and so the control current.

Figure 5:
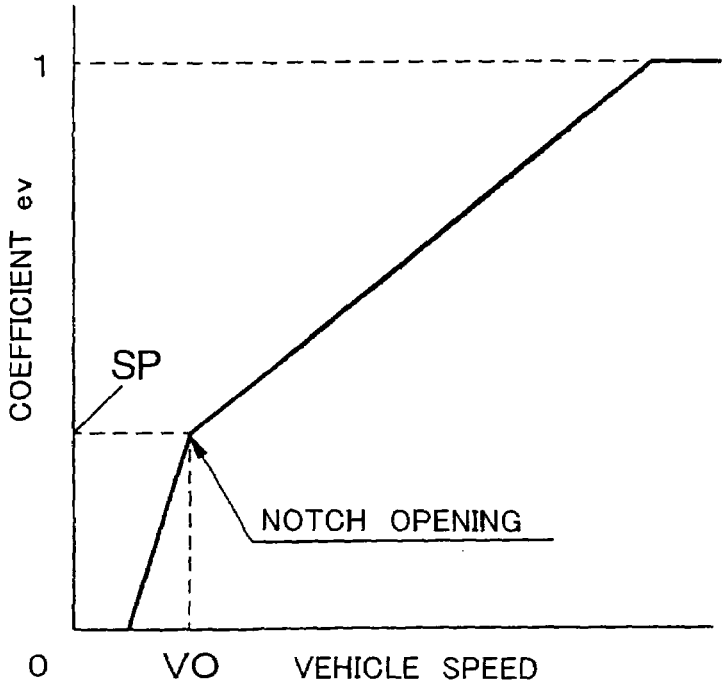
FIG. 5 is a diagram depicting one example of a relationship between a vehicle speed and a coefficient function set by the controller in the hydraulic ride control system according to the first embodiment of the present invention.

Referring next to FIG. 5, a description will be made of an illustrative relationship between a vehicle speed and a coefficient function set by the controller 21 shown in FIG. 2. The abscissa represents speeds of a vehicle, while the ordinate represents output-computing coefficients ev in the controller 21. In this example, a coefficient that ranges from 0 to 1 and determines the magnitude of a control current to be transmitted to the solenoid-operated proportional valve 12 is computed based on a travelling speed detected by the speed sensor 19. When the vehicle speed reaches a predetermined value $V_o$, the coefficient ev takes such a value SP that the opening control valve 5 is brought into the connecting position, and therefore, the opening control valve 5 begins to open. The higher the vehicle speed, the greater the coefficient ev, and so the control current. The coefficients ep,ev shown in FIGS. 4 and 5 will be described subsequently herein.

Figure 6:
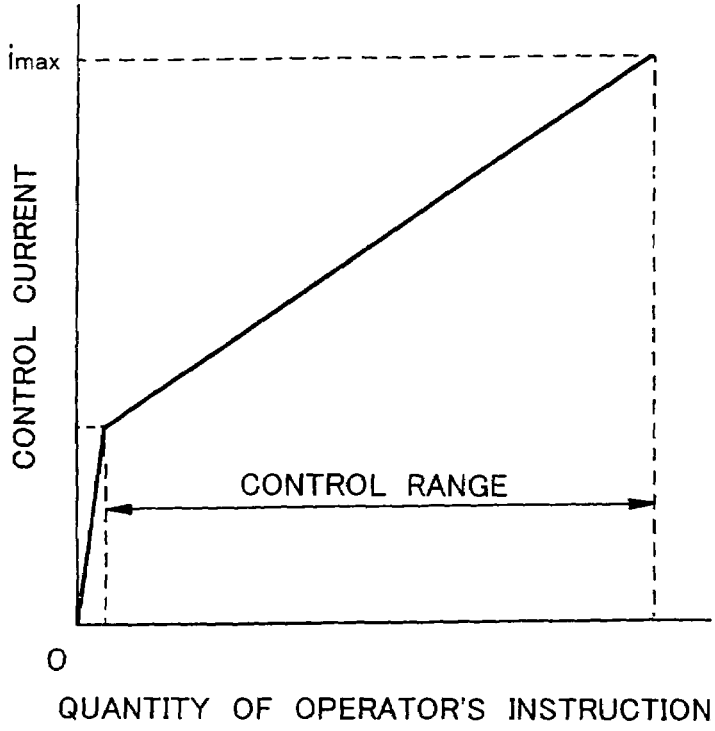
FIG. 6 is a diagram depicting one example of a relationship between the quantity of operator's instruction and a control current set by the controller in the hydraulic ride control system according to the first embodiment of the present invention.

With reference to FIG. 6, a description will next be made of an illustrative relationship between an operation stroke of the instruction switch 20 and a control current set by the controller 21 as depicted in FIG. 2. The abscissa represents control strokes of the instruction switch 20, namely, the quantities of operator's instructions, while the ordinate represents control currents to the solenoid-operated proportional valve 12. In this example, irrespective of the load pressure and the travelling speed, the magnitude of a control current to the solenoid-operated proportional valve 12 is determined by the quantity of operator's instruction, and the opening of the opening control valve 5 increases with the quantity of operator's instruction.

Figure 7:
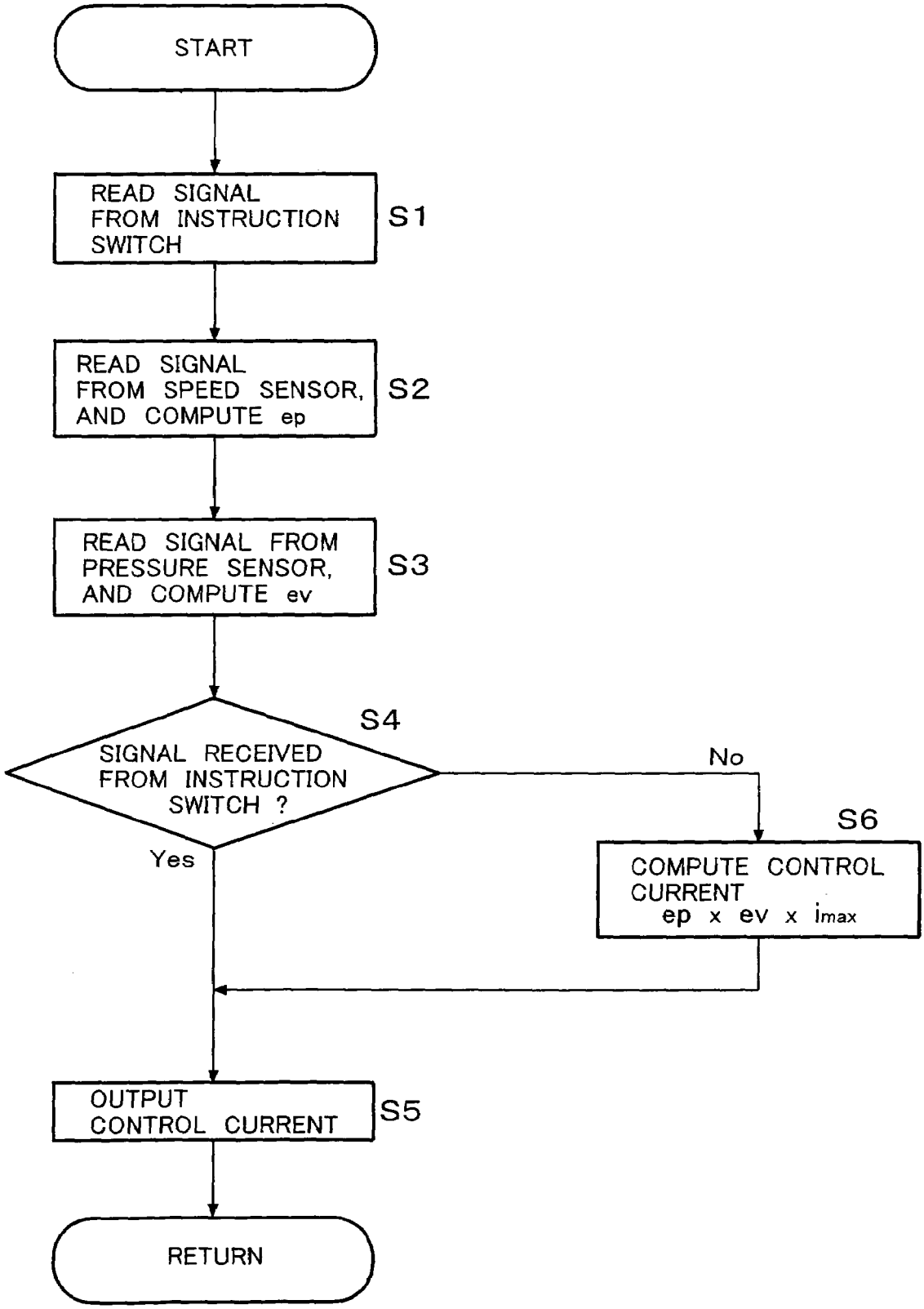
FIG. 7 is a flow chart illustrating one example of processing performed by the controller in the hydraulic ride control system according to the first embodiment of the present invention.

Based on the flow chart illustrated in FIG. 7, a description will next be made of illustrative processing which the controller 21 shown in FIG. 2 performs. While the wheel loader is carrying out work, the controller 21 receives signals from the pressure sensor 18, speed sensor 19 and instruction switch 20 (S4). At this time, the controller 21 determines whether or not there is a signal from the instruction switch 20 (S4) and, when there is the signal, outputs a control current corresponding to the quantity of operator's instruction (S5). When there is no signal, on the other hand, the controller 21 computes a control current corresponding to a load pressure and travelling speed (S6) and outputs it to the solenoid-operated proportional valve 12.

A description is now made about the computation of a control current. In FIG. 4 and FIG. 5, coefficients ep and ev corresponding to a load pressure and travelling speed were computed at the controller 21. In this embodiment, the product of these coefficients ep,ev and the control current $i_{max}$ for causing the opening control valve 5, which is shown in FIG. 3, to move through full stroke is used as a control current for the solenoid-operated proportional valve 12. As a consequence, the greater the load on the boom cylinders 3 and the greater the travelling speed, the greater the control current, and so the opening of the opening control valve 5. Even when the load pressure is large, the wheel loader is considered to be performing a digging travel insofar as the travelling speed does not reach a certain level as illustrated in FIG. 5. Accordingly, the control current is set so small that the opening control valve 5 does not open.

Referring FIG. 2 through FIG. 7, a description will now be made of an operation of the hydraulic ride control system according to the first embodiment. It is to be assumed that the operation will be performed without any signal from the instruction switch 20 in order to facilitate its description in combination with an operation of the wheel loader illustrated in FIG. 1.

While the wheel loader shown in FIG. 1 is performing digging, loading work or a digging travel, the travelling speed is low and the control current to the solenoid-operated proportional valve 12 has a small value, as described above with reference to FIG. 7. Accordingly, a pressure high enough to overcome the preset load on the spring 6 is not fed to the pressure chamber 5*a* of the opening control valve 5. The opening control valve 5, therefore, remains in the closed position A, in other words, the branch lines 9 and 10 are kept cut off.

While the wheel loader is travelling with a load, a control current corresponding to the load pressure and vehicle speed is outputted, as mentioned above, from the controller 21 to the solenoid-operated proportional valve 12, and corresponding to the output value, a pressure from the pressure supply 8 is controlled and then bled to the pressure chamber 5*a* of the opening control valve 5. When the pressure applied to the pressure chamber 5*a* increases to a level sufficient to overcome the preset load on the spring 6, the opening control valve 5 is caused to move through a stroke corresponding to the pressure in the pressure chamber 5*a*. As a result, the opening control valve 5 is brought into the closed position B, in other words, the branch lines 9 and 10 are brought into connected states, respectively, and during travelling, swings of the boom 1 are absorbed in the accumulator 7 via the boom cylinder 3 and the branch line 9. When the load on the front section of the wheel loader, in other words, the load pressure on the boom cylinder 3 is high, the opening of the opening control valve 5 becomes greater. When the load on the front section is small, on the other hand, the opening of the valve 5 becomes smaller.

According to the first embodiment constructed as described above, the opening of the opening control valve 5 is variably controlled by the controller 21 depending on the load pressure and vehicle speed. It is, therefore, possible to control the opening control valve 5 to an adequate opening corresponding to the weight of the front section, for example, the existence or non-existence of a load and the vehicle class, the load on the boom cylinders as a result of a change or the like in the front attachment, and the vehicle speed, and to suitably suppress vibrations of the wheel loader during travelling. In other words, excellent vibration suppression performance can be assured.

Second Embodiment

In the above-described first embodiment, the pressure of the accumulator 7 when the opening control valve 5 is in the closed position A is substantially equal to the pressure in the bottom pressure chambers 3*a* of the boom cylinder 3 when the opening control valve 5 was in the open position B shortly before its switching into the closed position A. The load pressure on the boom cylinders 3, however, frequently varies depending on the weight of the load, the holding angle of the boom 1, and the like. At the moment that the opening control valve 5 has been switched into the open position B, there is accordingly a difference in pressure between the bottom pressure chambers 3*a* of the boom cylinders 3 and the accumulator 7. Due to this pressure difference, an undesired motion such as sudden lowering of the boom 1 and as a result, a shock may take place to deleteriously affect the riding comfort.

Figure 8:
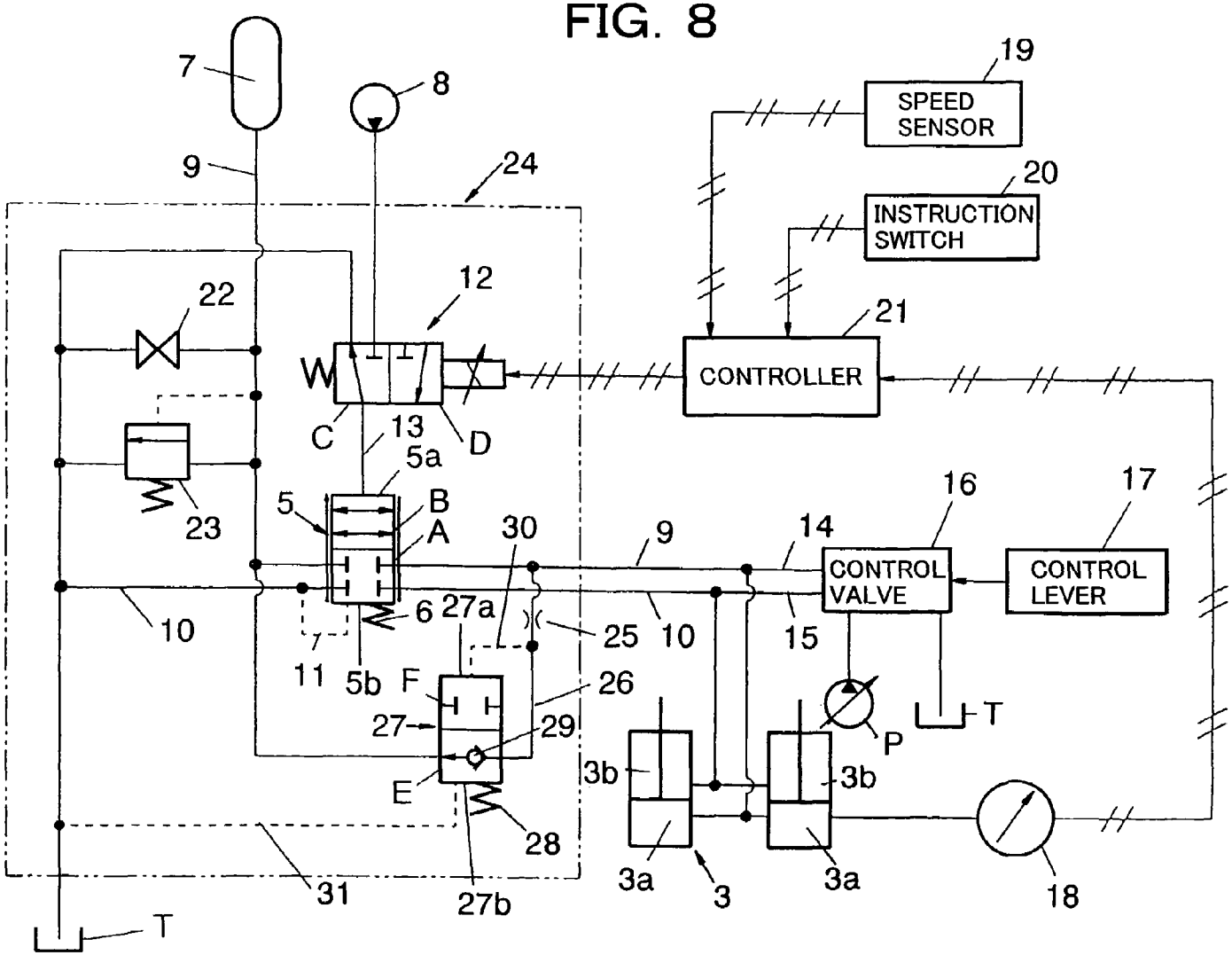
FIG. 8 is a circuit diagram illustrating a hydraulic ride control system according to a second embodiment of the present invention.
Figure 9:
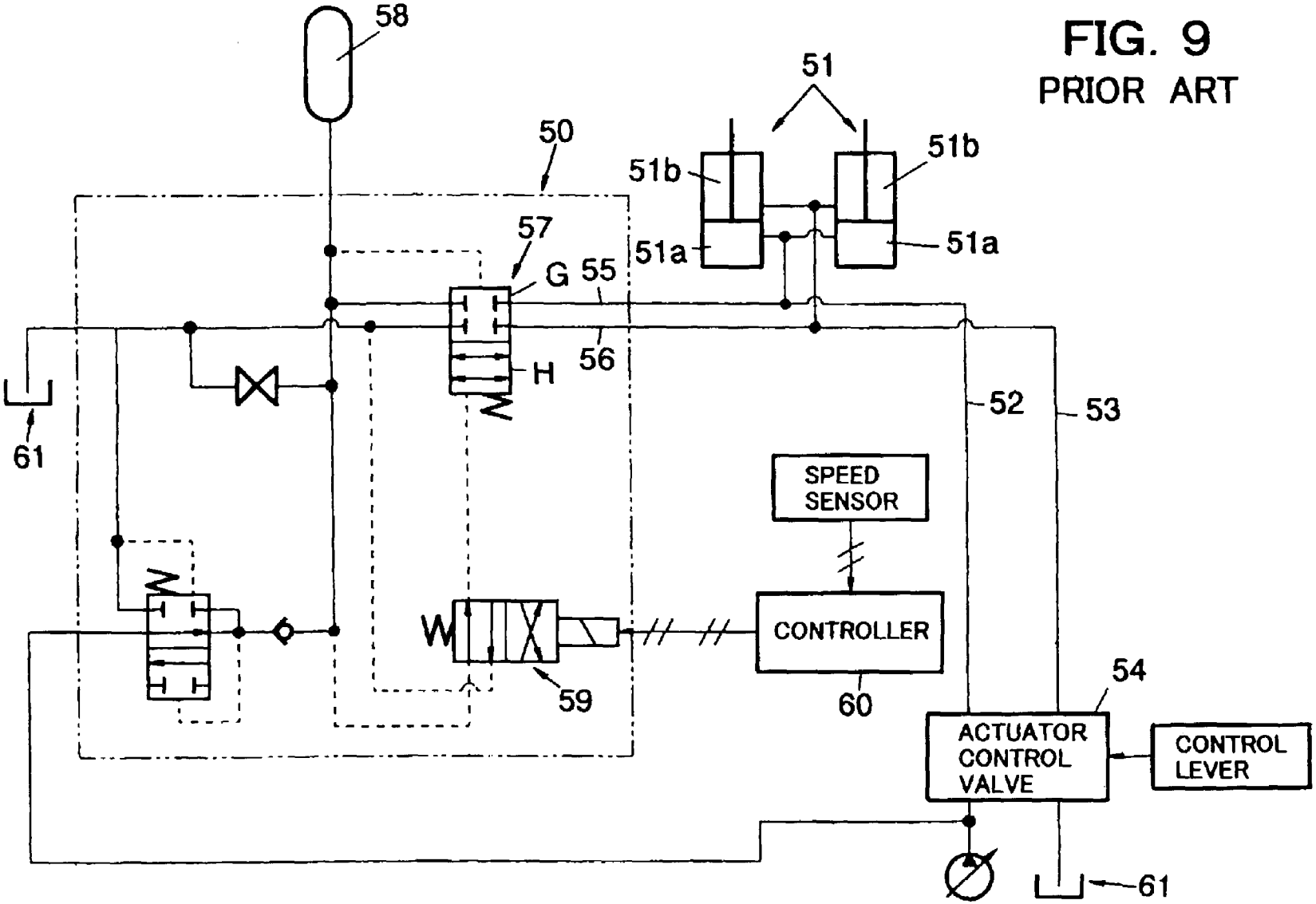
FIG. 9 PRIOR ART
FIG. 9 is a circuit diagram illustrating a conventional hydraulic ride control system for a working vehicle.

With reference to the circuit diagram shown in FIG. 8, the hydraulic ride control system according to the second embodiment of the present invention will be described hereinafter. Upon describing the second embodiment, those parts of the hydraulic ride control system which are the same as or equivalent to the corresponding parts in the first embodiment will be designated by the same reference numerals, and their description will be omitted. Only those parts of the hydraulic ride control system which are different from the corresponding parts in the first embodiment will be described.

On the branch line 9 which connects the bottom pressure chambers 3*a* of the boom cylinders 3 and the accumulator 7 with each other, a bypass line 26 is arranged in parallel with the opening control valve 5, and on the bypass line 26, a restrictor 25 and a selector valve 27 are arranged in this order from the upstream. The selector valve 27 is a 2-port-2-position selector valve. To one of pressure changes of the selector valve 27, that is, a pressure chamber 27*a*, a pressure on a downstream side of the restrictor 25 is led, and the other pressure chamber, that is, a pressure chamber 27*b* is connected to the reservoir T via a drain line 31. The selector valve 27 is also equipped with a return spring 28.

Normally, the selector valve 27 remains in an open position E so that the bottom pressure chambers 3*a* of the boom cylinders 3 and the accumulator 7 are kept connected via the bypass line 26. When the pressure in the bottom pressure chambers 3*a* of the boom cylinders 3 rises and the pressure in the pressure chamber 27*a* becomes higher the pressure set by the return spring 28, the selector valve 27 is brought into a closed position F so that the bypass line 27 is cut off.

Further, a check valve 29 is arranged at the open position E of the selector valve 27, and permits only a flow from the bottom pressure chambers 3*a* of the boom cylinders 3 toward the accumulator 7.

According to the second embodiment constructed as described above, the bottom pressure chambers 3*a* of the boom cylinder 3 and the accumulator 7 are connected together via the bypass line 26 even when the opening control valve 5 is in the closed position A. The pressure in the accumulator 7 can, therefore, be brought close to the pressure in the bottom pressure chambers 3*a* of the boom cylinder 3, leading to a reduction in the pressure difference between the accumulator 7 and the bottom pressure chambers 3*a* of the boom cylinder 3. Even at the moment that the opening control valve 5 has been switched into the open position B, an undesired motion of the boom can be lessened to suppress a shock on the vehicle. Owing to the arrangement of the restrictor 25 on the bypass line 26, it is also possible to suppress the absorption of a digging pressure, which is applied to the boom cylinders 3, in the accumulator 7. Other operations and advantageous effects are as described above with respect to the first embodiment.

It is to be noted that, although the relationships between the load pressure and vehicle speed and the coefficient functions ep,ev are set at the controller 21 in the above-described first and second embodiments, the present invention is not limited to the setting of such relationships and relationships between the load pressure and vehicle speed and the control currents can be set there.

Further, the above-described first and second embodiment can also be constructed such that the controller 21 is provided with a clock means to measure a time from the time point of an input of a signal from the speed sensor 19 into the controller 21, a control signal, in other words, a control current capable of holding the opening of the opening control valve 5 relatively small, for example, during a predetermined time is outputted from the controller 21 to the solenoid-operated proportional valve 12, and a control current capable of gradually increasing the opening of the opening control valve 5 is outputted from the controller 21 to the solenoid-operated proportional valve 12 from a time point beyond the above-mentioned predetermined time.

With the hydraulic ride control systems constructed as described above, the opening of the opening control valve 5 can be smoothly brought from the closed position A into the open position B and further from a small opening position into a large opening position upon initiation of travelling with a load. It is, therefore, possible to avoid the occurrence of an impact on the wheel loader which would otherwise be applied as a result of opening of the opening control valve 5.

This application claims the priority of Japanese Patent Application 2004-331888 filed Nov. 16, 2004, which is incorporated herein by reference.

What is claimed:

1. A hydraulic ride control system for a working vehicle, said system comprising:

a hydraulic cylinder, an actuator control valve for controlling a pressure in a pressure chamber of said hydraulic cylinder, an accumulator connected to a bottom side of said pressure chamber of said hydraulic cylinder via a first connection line, a reservoir connected to a rod side of said pressure chamber of said hydraulic cylinder via another, second connection line that is independent of said first connection line, a normally closed opening control valve having a pilot chamber for selectively communicating or cutting off said connection lines depending on a pressure in said pilot chamber, a load pressure detection means for detecting a load pressure on said hydraulic cylinder and outputting a signal corresponding to said load pressure, a vehicle speed detection means for detecting a vehicle speed of said working vehicle and outputting a signal corresponding to said vehicle speed, a selector means for selectively feeding a pressure to or draining a pressure from said pilot chamber, and a clock means for measuring time from a time point of an input of a signal from a speed sensor or a load pressure sensor into a controller, wherein, responsive to a signal outputted from at least one of said load pressure detection means and said vehicle speed detection means, said control means changes an opening of said opening control valve, and wherein a control signal holding the opening of the opening control valve small is outputted from the controller to the selector means during a predetermined time while a control signal increasing gradually the opening of the opening control valve is outputted from the controller to the selector means from a time point beyond said predetermined time.

2. A hydraulic ride control system according to claim 1, wherein said selector means comprises a solenoid-operated proportional valve for controlling said opening control valve.

3. A hydraulic ride control system according to claim 1, wherein said hydraulic ride control system further comprises an opening instruction means for outputting, responsive to an input by an operator, a signal that instructs an opening of said opening control valve; and responsive to said signal outputted from said opening instruction means, said control means changes said opening of said opening control valve.

4. A hydraulic ride control system according to claim 1, wherein the selector means is a solenoid operated proportional valve.

5. A hydraulic ride control system for a working vehicle, said system being provided with a hydraulic cylinder, an actuator control valve for controlling a pressure in a pressure chamber of said hydraulic cylinder, an accumulator connected to said pressure chamber of said hydraulic cylinder via a connection line, an opening control valve having a pilot chamber for selectively communicating or cutting off said connection line depending on a pressure in said pilot chamber, and a selector means for selectively feeding a pressure to or draining a pressure from said pilot chamber, wherein said selector means comprises a control means for variably controlling an opening of said opening control valve, wherein said hydraulic ride control system further comprises a selector valve arranged on a bypass line branching out from said connection line and disposed in parallel with said opening control valve such that said bypass line is normally maintained in communication but is cut off when a load pressure on said hydraulic cylinder has increased to at least a predetermined pressure.

6. A hydraulic ride control system according to claim 5, wherein a check valve is arranged on said bypass line to bleed a pressure only from said hydraulic cylinder to said accumulator.

* * * * *